US007758339B2

(12) United States Patent
Jhawar et al.

(10) Patent No.: US 7,758,339 B2
(45) Date of Patent: Jul. 20, 2010

(54) METHOD AND APPARATUS FOR DIRECTIONAL AND CONTROLLED COOLING IN VACUUM FURNACES

(75) Inventors: Suresh C. Jhawar, Anaheim Hills, CA (US); Ronald Garcia, Moreno Valley, CA (US)

(73) Assignee: Jhawar Industries, Inc., Corona, CA (US)

( * ) Notice: Subject to any disclaimer, the term of this patent is extended or adjusted under 35 U.S.C. 154(b) by 886 days.

(21) Appl. No.: 11/208,282

(22) Filed: Aug. 18, 2005

(65) Prior Publication Data

US 2007/0042309 A1 Feb. 22, 2007

(51) Int. Cl.
*F27B 5/04* (2006.01)
*F27B 5/16* (2006.01)

(52) U.S. Cl. ..... 432/205; 432/212

(58) Field of Classification Search ..... 432/77, 432/200, 205; 373/110, 111, 112; 34/233
See application file for complete search history.

(56) References Cited

U.S. PATENT DOCUMENTS 2,311,350 A * 2/1943 Richardson ..... 431/8
4,239,484 A * 12/1980 Schuster ..... 432/77
4,395,832 A * 8/1983 Jones et al. ..... 34/233
4,490,110 A * 12/1984 Jones ..... 432/205
4,560,348 A * 12/1985 Moller et al. ..... 432/77
4,643,401 A * 2/1987 Obman et al. ..... 266/80
4,765,068 A * 8/1988 Ripley ..... 432/77
4,836,776 A * 6/1989 Jomain ..... 432/205
5,267,257 A * 11/1993 Jhawar et al. ..... 373/110
5,502,742 A * 3/1996 Kellogg et al. ..... 432/77
6,349,108 B1 * 2/2002 Ashburn ..... 373/110
7,089,681 B2 * 8/2006 Herbert et al. ..... 34/92
2007/0069433 A1 * 3/2007 Jones ..... 266/252
2007/0122761 A1 * 5/2007 Katsumata ..... 432/77
2007/0212657 A1 * 9/2007 Katsumata et al. ..... 432/77

FOREIGN PATENT DOCUMENTS

EP 0 129 701 5/1984
JP 11 153386 6/1999

* cited by examiner

*Primary Examiner*—Gregory A Wilson
(74) *Attorney, Agent, or Firm*—Christie, Parker & Hale, LLP

(57) ABSTRACT

A vacuum furnace with a gas manifold branching into a plurality of secondary gas manifolds, the secondary gas manifolds each including a valve that is contained in each secondary gas manifold;

a hot gas plenum including an inner and an outer shell with the outer shell attached at one side to the secondary gas manifold;

a series of gas restrictor walls between the inner and outer shells of the hot gas manifold that serves the purpose of dividing the plenum into a plurality of non-circumferential sectors so that the load in the plenum may be cooled from the top, bottom, left, or right side or any combination thereof.

19 Claims, 12 Drawing Sheets

METHOD AND APPARATUS FOR DIRECTIONAL AND CONTROLLED COOLING IN VACUUM FURNACES

BACKGROUND OF THE INVENTION

Vacuum furnaces for heat treating, brazing, sintering, and other heat processing generally run cycles with heating ramps that are controlled or uncontrolled to some set point temperature. The parts, load, or work are then cooled down. Cooling modes include vacuum or non-circulated inert gas cooling, forced gas cooling via circulation, controlled cooling, or a combination of different cooling steps.

There are two types of forced circulated inert gas cooling designs commonly used. The first type involves mounting the blower, fan, and motor assembly with heat exchanger internally to the main vacuum vessel. Alternatively, these parts can also be mounted outside of the vacuum chamber via piping connections. Both approaches work; however, the internal type of cooling arrangement tends to require higher and more frequent maintenance due to the proximity of the moving parts to the heated areas.

Further, many loads being cooled in such furnaces are not uniform in density or mass. Instead, they often have bases with greater densities or hearth masses. As a result, the uniform cooling provided by traditional furnaces causes certain portions of the load to cool at a higher rate resulting in warping or other damage to the load.

This invention relates to controlled and directional cooling to provide optimum metallurgical results while minimizing distortion on the parts being processed within the vacuum furnace. This concept has been used for furnaces with internal cooling arrangements, and directional cooling for such an arrangement has been traditionally achieved via moving baffles. These baffles are, however, directly exposed to the heat inside the furnace. As such, they tend to warp and thus fail to open or close to the desired set point resulting in poor performance. The present invention uses an external arrangement that removes the dangers involved in using internal parts and thus provides reliable, repeatable, and predictable performance and results.

Currently, external gas cooling arrangements use a design that cools the entire internal chamber uniformly or that divides the internal chamber, or plenum, into three or four circumferential rings. The multiple circumferential plenum design provides the capability for different levels of cooling from the front to the rear of the chamber; however, such a design still results in a great deal of distortion. Most loads have a different hearth mass at the bottom as opposed to somewhere along the length, so lengthwise difference in cooling rate still results in uneven cooling and the possibility of warping or damage to the load. Other furnaces have been produced where gas circulates through an internal chamber in the plenum and enters the hot zone enclosure of the plenum through nozzles; however, such an arrangement still provides uniform cooling. Even in designs where the plenum does not completely wrap around the entire hot zone enclosure, the plenum wraps around a significant portion of the hot zone enclosure (e.g., 95%), and the nozzles are positioned in such a manner as to still provide uniform cooling. The present invention is directed at an external gas cooling arrangement providing directional cooling from non-circumferential sectors so that different levels of cooling may be applied to the load from different sections of the circumference of the plenum.

SUMMARY OF THE INVENTION

The present invention, in one aspect, comprises a cooling vacuum furnace where there is an external gas cooling arrangement and a design that divides the internal chamber of the plenum into a plurality of non-circumferential sectors. This design provides different levels of cooling to different areas of the load so as to minimize warping. Specifically, the plenum may, in one embodiment, comprise both an inner and an outer wall, the outer wall being connected to secondary piping manifolds from which inert gas is supplied and the inner wall having a plurality of gas nozzles, such as threaded tank flanges as in the preferred embodiment. The plenum may further comprise a series of gas restricting walls that stand between the inner and outer walls of the plenum when it is fully assembled. These gas path restrictors divide the space between the inner and outer walls into a plurality of chambers, each chamber corresponding to one non-circumferential sector of the plenum. In the preferred embodiment, each secondary piping manifold connects to the outer wall and directs gas into only one of the chambers. Thus, the gas provided through each piping manifold travels through only one sector of the plenum and into the inner-most chamber of the plenum through that sector's gas nozzles. This allows the invention to provide directional cooling.

In another aspect, the present invention is directed at the manufacturing of a plenum divided into a plurality of non-circumferential sectors such that the inner wall of the plenum is formed with gas path restrictor walls fixedly attached with the outer wall being formed from several pieces that are then fixedly attached to the opposite side of each wall.

In yet another aspect, the present invention is directed at a gas inlet manifold wherein one primary gas inlet supply divides into a plurality of secondary gas inlet supplies, each containing a valve, such as a pneumatic actuating proportional butterfly throttle valve as in the preferred embodiment, for the purpose of regulating gas flow. In another aspect, the invention is directed at a method of manufacturing said manifold.

Another aspect of the invention is directed at a manual or automated method for controlling gas flow for cooling within a vacuum furnace.

In yet another aspect, the present invention is directed to a gas manifold mounted on only one side of the plenum.

One or more embodiments of the present invention may have one or more of the following features:

1. A vacuum furnace that may provide directional cooling in the plenum.
2. A vacuum furnace which has primary and secondary gas manifolds all connected to only one side of the plenum.
3. A plenum consisting of an inner and an outer shell with gas path restrictor walls between the shells so that gas pumped into the plenum is diverted to one of a plurality of non-circumferential sectors.

The above description in no way limits the scope of the invention. Additional advantages and novel features of the invention will be set forth in part in the description which follows and will become apparent to those skilled in the art upon examination of the following or may be learned by practice of the invention. The following detailed description describes only the preferred embodiment of the invention, simply by way of illustration of the best mode contemplated for carrying out the invention. As will be realized, the invention is capable of other and different embodiments, and its several details are capable of modifications in various respects, all without departing from the invention. Accordingly, the drawings and description are to be regarded as illustrative in nature and not as restrictive.

DETAILED DESCRIPTION OF THE INVENTION

Figure 1:
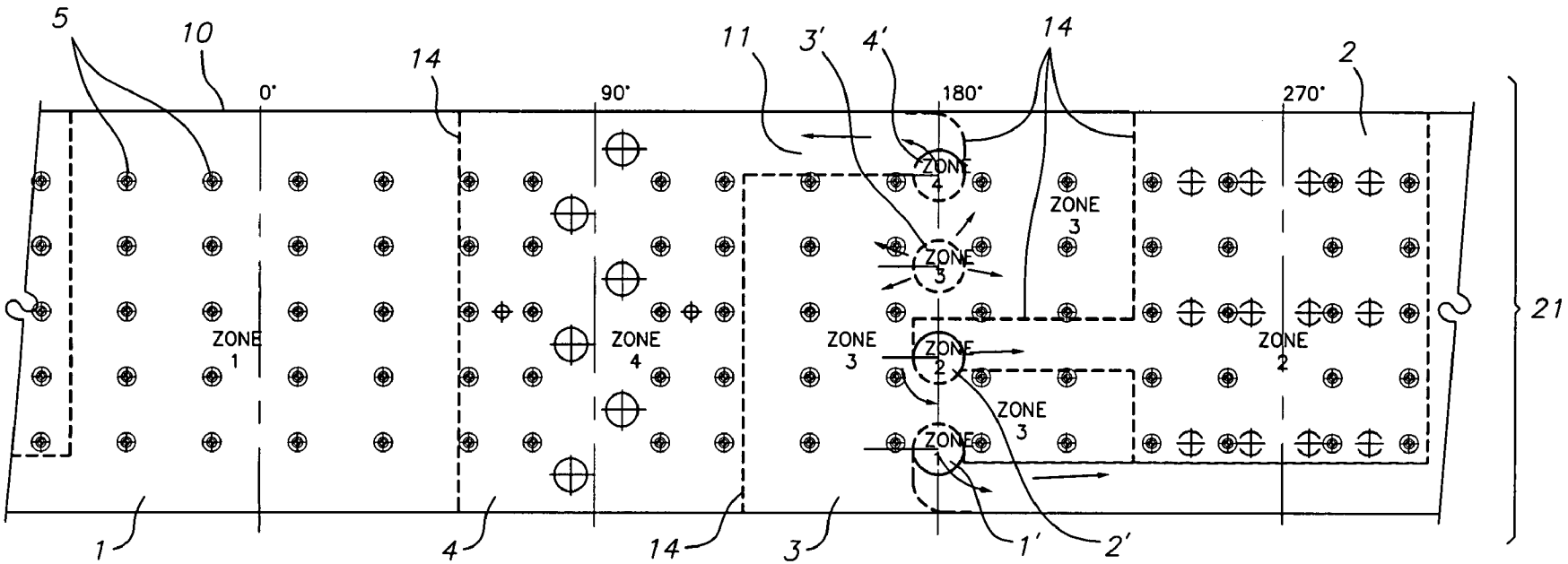
FIG. 1 shows a plan view of an inner wall of a plenum according to one embodiment of the present invention if it were rolled out flat and indicates gas path restrictors and zone coverage.

FIG. 1 is a flat layout of the wall of the inner plenum 10 of the furnace. The plenum contains a series of gas restrictor walls 14 that may, in one embodiment, run perpendicular to the inner wall 21 and outer wall of the plenum and that, in the preferred embodiment, divide the inner chamber of the plenum 10 into four sectors or zones 1, 2, 3, and 4. In alternate embodiments, the inner chamber of the plenum may have any number of zones that best suits the needs of the user.

For instance, the plenum may be designed to have anywhere between two and eight zones, or it may even have more zones. To further illustrate, if a manufacturer needs to have a level of cooling along the bottom third of the load that is different from the top two-thirds, then a two zone plenum could be manufactured at a cost less expensive than that of a four or eight zone plenum. In manufacturing the plenum, any number of gas restrictor walls 14 can be fixed, such as through welding to the inner wall 21 so as to create the necessary number of zones. The outer wall can then be assembled from pieces that, when fixed together, cover the span of each zone and have their edges fixed, such as through welding, to the top edges of the gas restrictor walls 14. Because pieces of the outer wall can be custom fit to any size, the gas restrictor walls 14 can connect to the inner wall 21 at any angle the manufacturer finds suitable.

In the preferred embodiment, each zone contains a plurality of threaded tank flanges on the inner wall that serve as gas nozzles 5 to allow gas to flow into the plenum's inner chamber.

Each of the secondary gas inlets corresponds to one zone so that gas 11 only flows from one gas inlet into only one zone. For example, gas flowing through secondary gas inlet 1' only flows into zone 1; gas flowing through secondary gas inlet 2' only flows into its corresponding zone 2; gas flowing through secondary gas inlet 3' only flows into its corresponding zone 3; and gas flowing through secondary gas inlet 4' only flows into its corresponding zone 4.

Gas 11 flows from each gas inlet and remains contained within the gas inlet's corresponding zone by the gas restrictor walls 14. Any gas that enters a zone flows through the zone's gas nozzles 5 that lead to the plenum's inner chamber.

Figure 2:
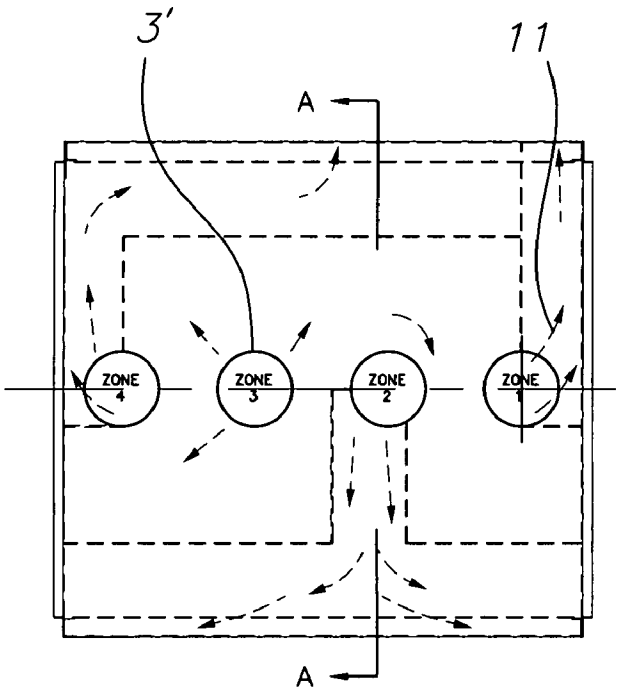
FIG. 2 shows a set of connections between a gas manifold and the plenum.
Figure 2B:
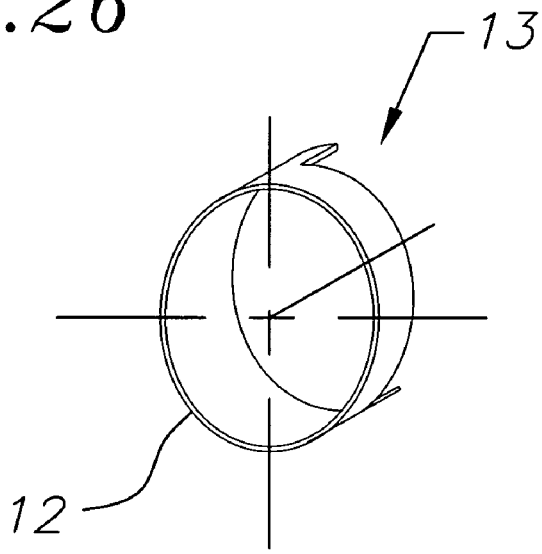
FIG. 2*b* shows a perspective view of a portion of a gas inlet between the inner wall and the outer wall of the plenum.

Turning to FIG. 2, gas 11 flow from the inlets (e.g., 3') into each of the zones or chambers is depicted. In FIG. 2*b*, a perspective view of the portion of the inlet that lies between the inner and outer walls of the plenum is shown. In the preferred embodiment, the piping of each inlet 12 contains a 180-degree notch 13 so as to aid in the direction of the gas flow 11 into the chamber that constitutes a particular zone.

Figure 4:
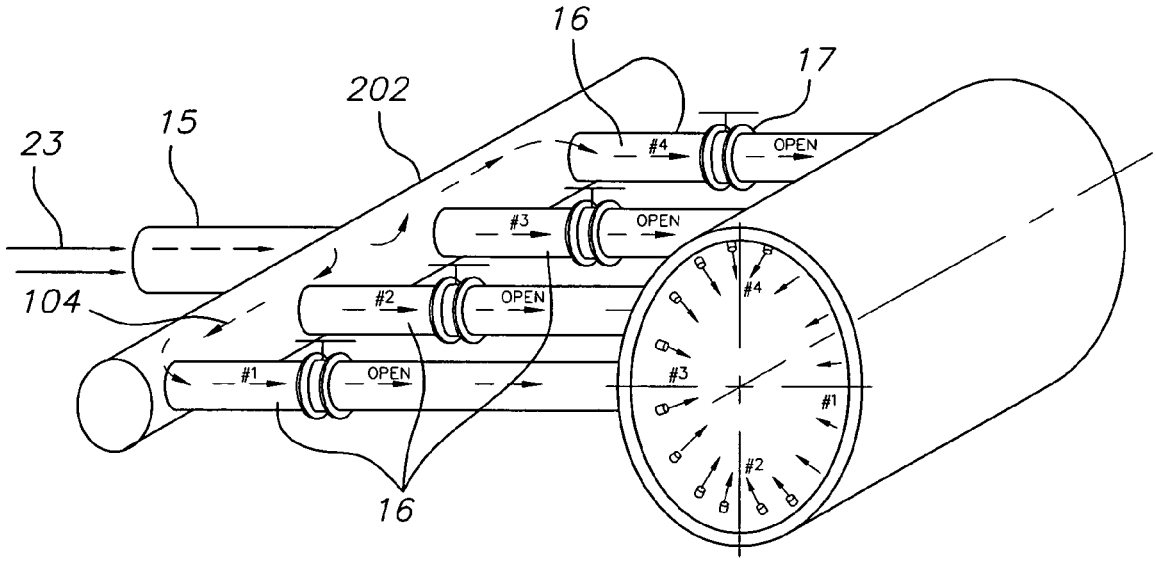
FIG. 4 shows the plenum where secondary gas inlet valves are adjusted so that some amount of gas is flowing to each of four quadrants of the plenum.
Figure 5:
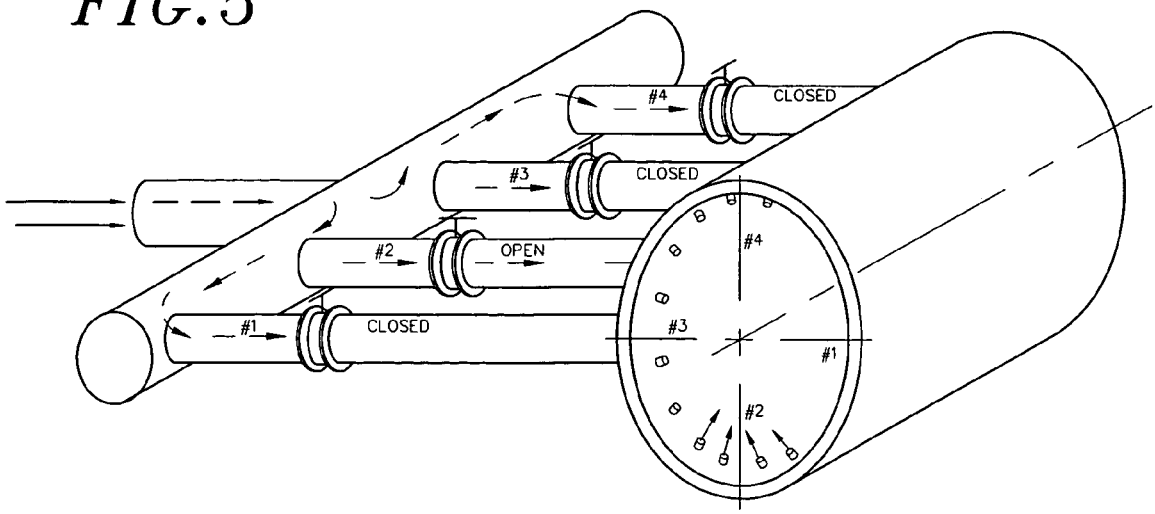
FIG. 5 shows the plenum where the secondary gas inlet valves are adjusted so that some amount of gas is flowing to only the bottom quadrant of the plenum.
Figure 6:
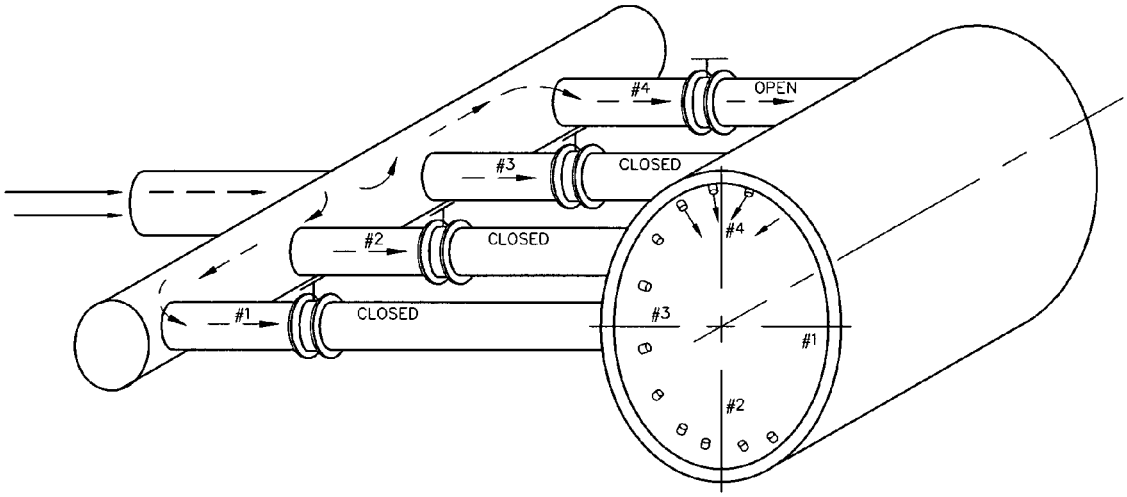
FIG. 6 shows the plenum where the secondary gas inlet valves are adjusted so that some amount of gas is flowing to only the top quadrant of the plenum.
Figure 7:
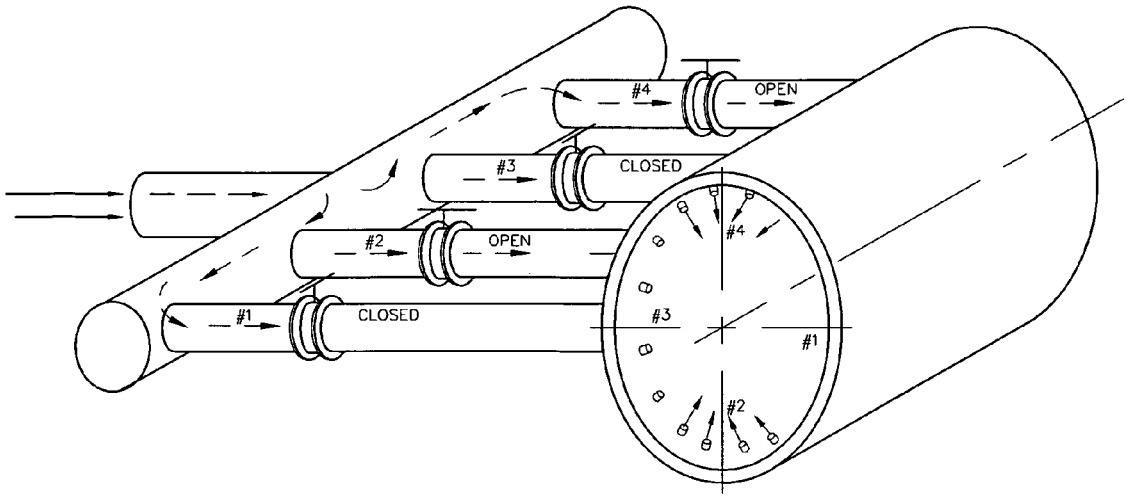
FIG. 7 shows the plenum where the secondary gas inlet valves are adjusted so that some amount of gas is flowing to both the top and the bottom quadrants of the plenum.
Figure 8:
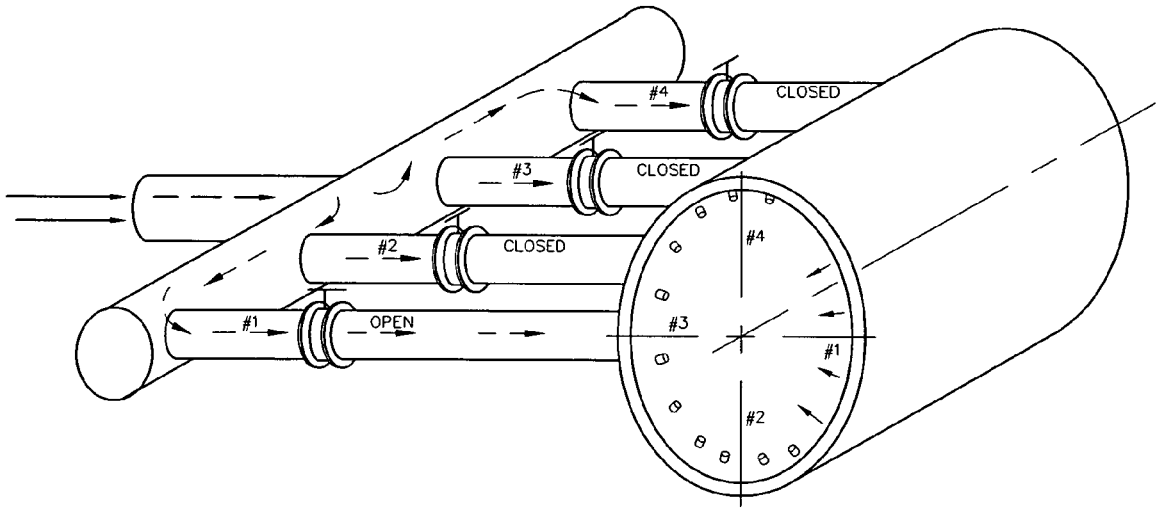
FIG. 8 shows the plenum where the secondary gas inlet valves are adjusted so that some amount of gas is flowing to only the right quadrant of the plenum.
Figure 9:
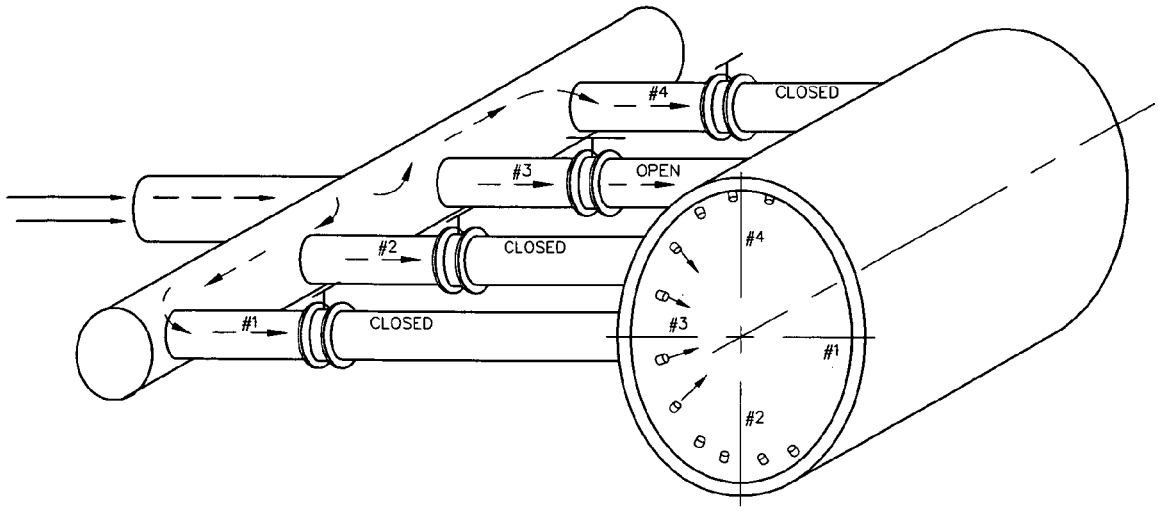
FIG. 9 shows the plenum where the secondary gas inlet valves are adjusted so that some amount of gas is flowing only to the left quadrant of the plenum.
Figure 10:
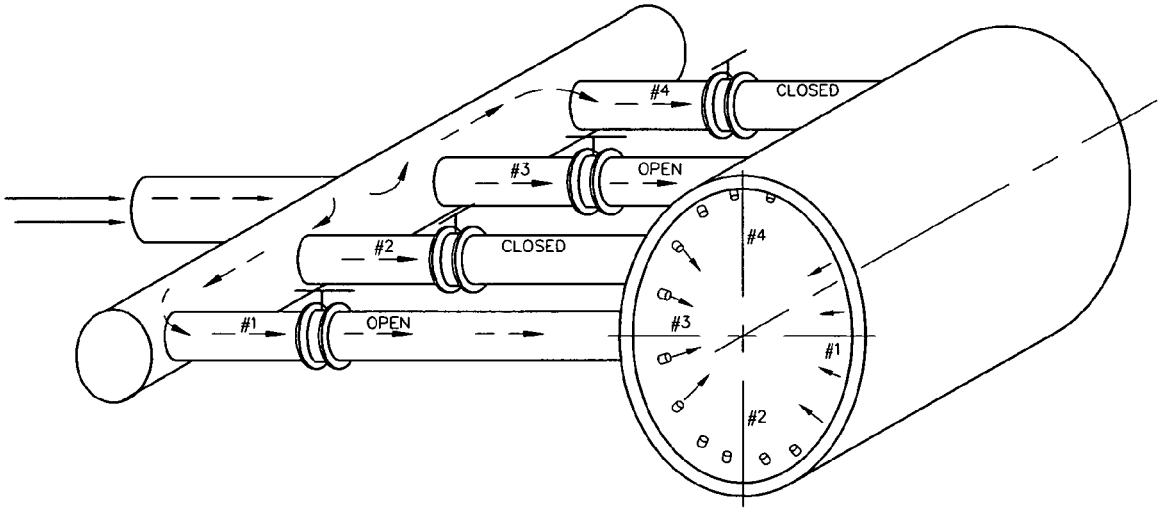
FIG. 10 shows the plenum where the secondary gas inlet valves are adjusted so that some amount of gas is flowing to both the right and the left quadrants of the plenum.
Figure 11:
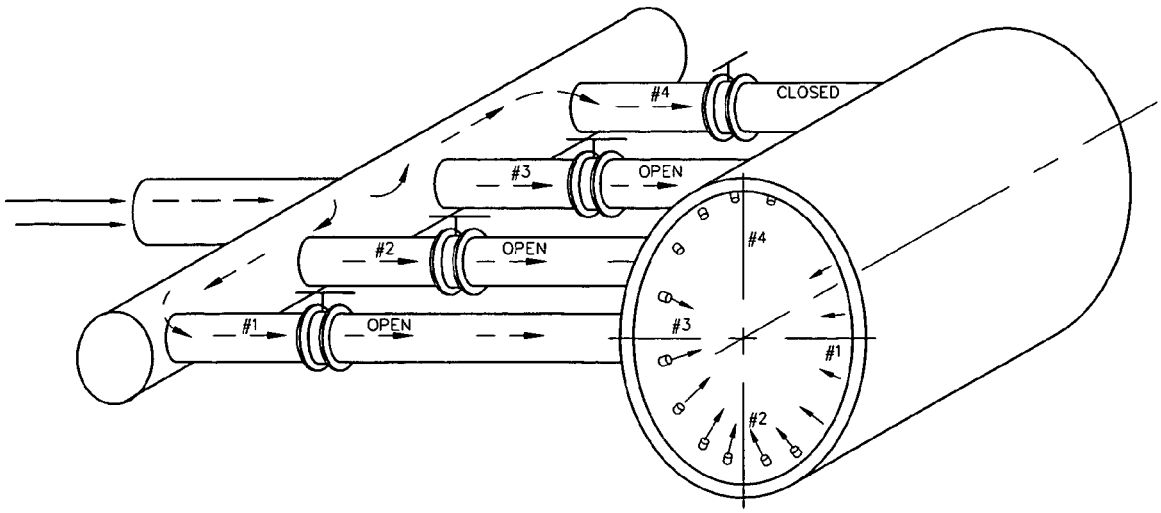
FIG. 11 shows the plenum where the secondary gas inlet valves are adjusted so that some amount of gas is flowing to only the bottom three-quarters of the plenum.
Figure 12:
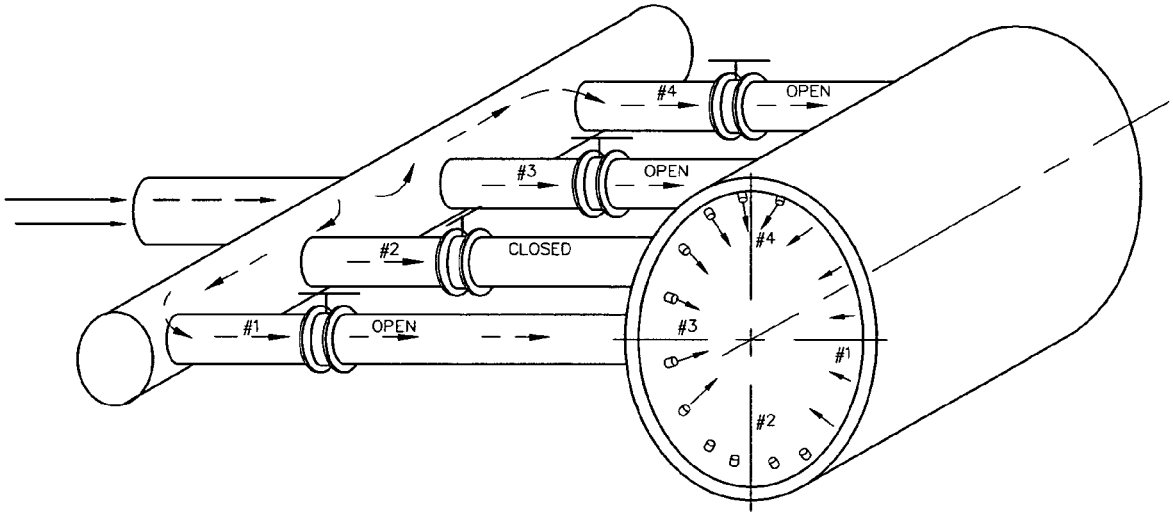
FIG. 12 shows the plenum where the secondary gas inlet valves are adjusted so that some amount of gas is flowing to only the top three-quarters of the plenum.

In one embodiment, as seen in FIG. 4, the cooling gas 23 enters the furnace via a main gas inlet pipeline 15. The gas 104 reaches the gas inlet manifold 202 and is divided into four separate secondary gas inlet supplies 16. A valve 17 in each of the secondary gas inlet supplies 16 controls the flow of the gas. The valves 17 may each be opened or closed to varying degrees in order to regulate the amount of gas flowing through each secondary gas inlet that may reach the plenum 20.

Figure 3:
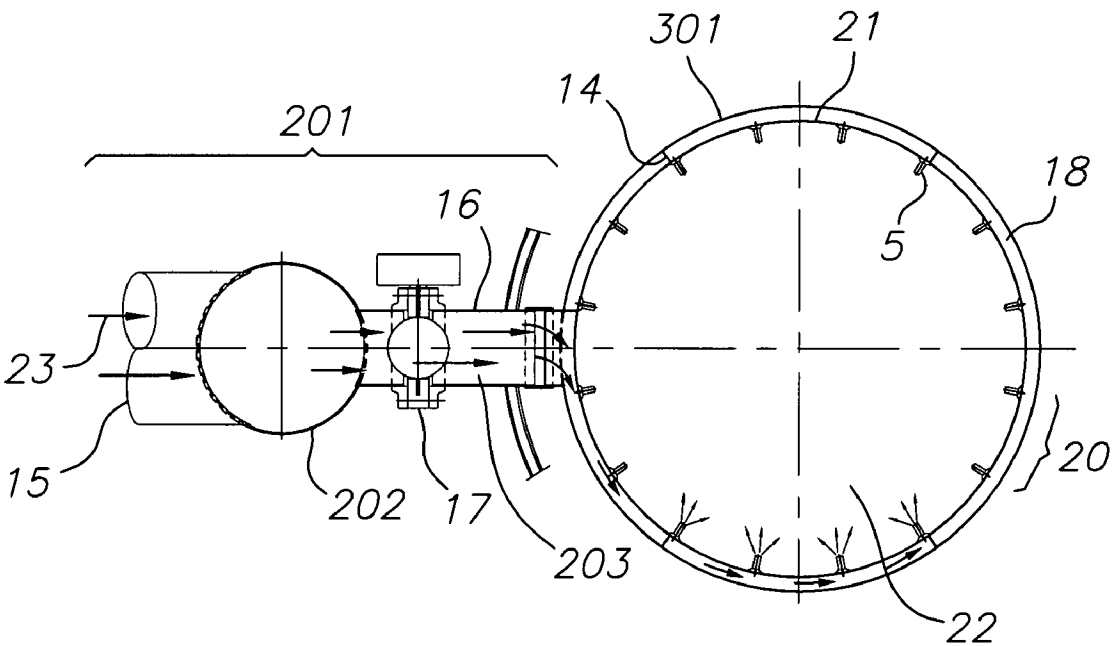
FIG. 3 shows a front view of the plenum and the gas manifold in section so that one can see internal valving.

FIG. 3 shows an alternate view of the process shown in FIG. 4. The cooling gas 23 is pumped into the furnace via a main gas inlet supply 15 in the gas manifold 201. Upon reaching the gas inlet manifold 202, the gas flow is divided into four secondary gas inlet supplies 16. A valve 17 in each of the secondary gas inlet supplies 16 controls the flow of the gas 203. The valves 17 may each be opened or closed to varying degrees in order to regulate the amount of gas flowing through each secondary gas inlet that may reach the plenum 20.

Figure 3B:
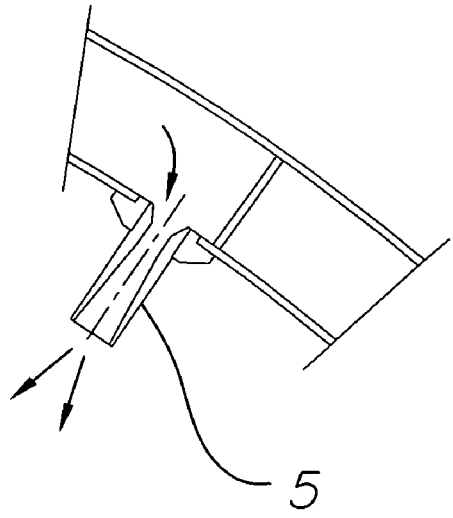
FIG. 3*b* shows a close-up view of a portion of the plenum and one of the gas nozzles from FIG. 3.

The gas then flows within the cavity 18 between the inner wall 21 (which corresponds to the inner wall 21 in FIG. 1) and the outer wall 301 of the plenum 20. The gas is contained within its particular zone by the gas path restrictor walls 14, which correspond to the gas path restrictor walls 14 in FIG. 1. The gas then passes through the gas nozzles 5 of its particular zone 1, 2, 3, or 4 into the hot zone of the inner plenum 22. In FIG. 3*b*, a close-up version of one of the nozzles 5 from FIG. 3 is shown.

Thus, through the regulation of the valves, different amounts of gas may be applied to different non-circumferential sectors of the plenum. This also allows one to alternate zones, sequence zones, or any combination thereof as shown in FIGS. 4-12. In the preferred embodiment, the regulation of the valves is computerized allowing for computer modeling to determine the best sequence for a particular load. Thermo couples can be placed in the furnace, by themselves or with the load, so as to provide data feedback to the computer regarding temperature levels at different points. Through one or more heating and cooling iterations, the computer can model the ideal cooling sequence for a particular load and can then automatically regulate the valve sequences for subsequent loads to provide optimal cooling.

In the presently preferred embodiment shown in the drawings, the secondary gas inlet supplies all enter the furnace along one side. In other words, as shown in FIGS. 4-12 the gas inlets all enter the cylindrical plenum along a single hemisphere of the plenum. As one of ordinary skill in the art will appreciate, an observer standing next to the cylindrical plenum is able to view one side or hemisphere of the cylindrical plenum from that position. Conveying the gas to the particular circumferential sector is handled by arranging the restrictor walls appropriately. This approach minimizes the amount of external piping and the foot print or floor space required for a furnace. However, the secondary gas inlet supplies could be configured to enter the furnace at or near the particular sectors with which they are each associated. This alternate approach would require additional external piping, but may simplify the arrangement of the restrictor walls. Either approach or some combination of both may be adopted as suitable for a particular situation.

Figure 13:
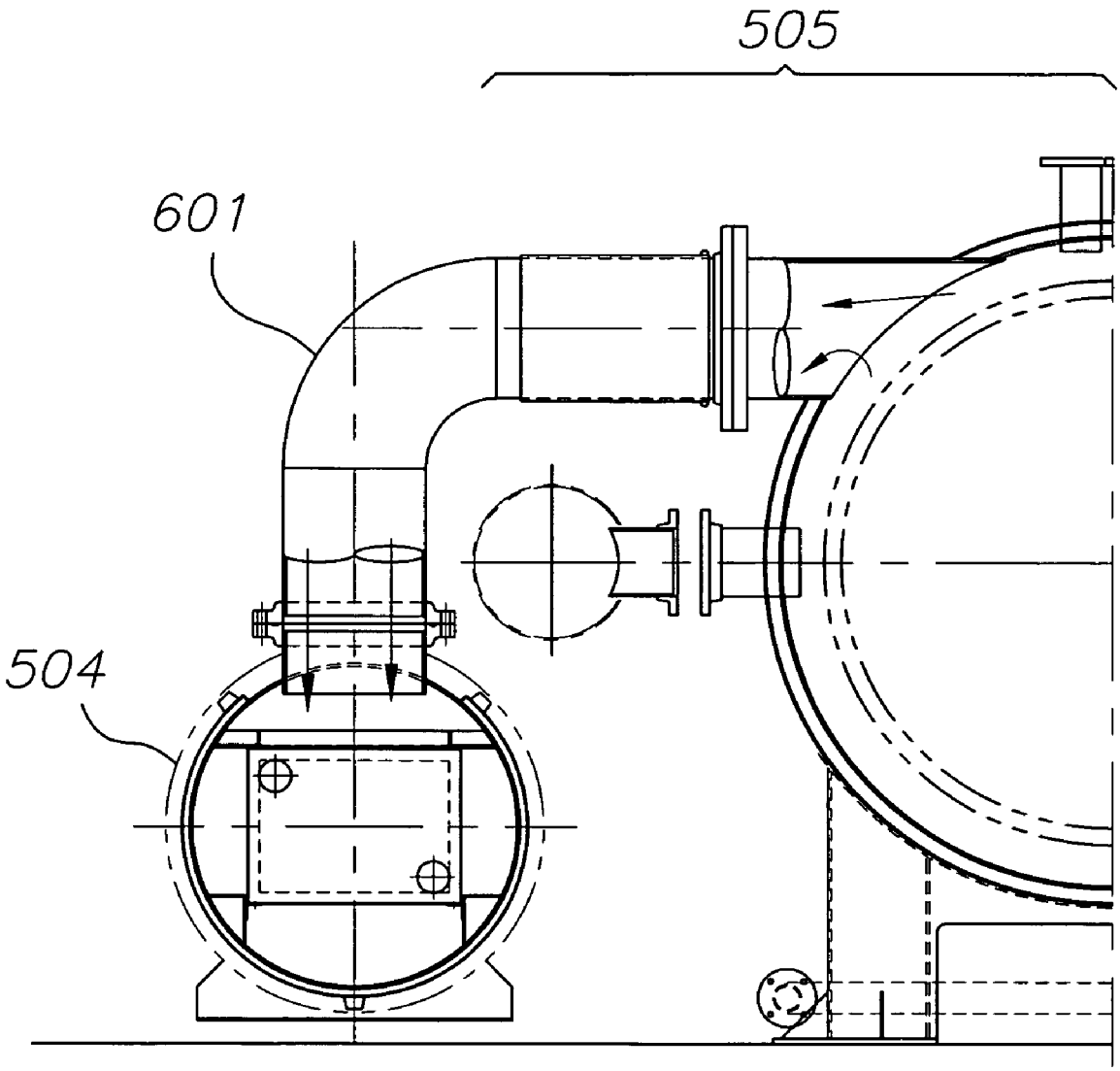
FIG. 13 shows a front view of one embodiment of a vacuum furnace according to the present invention.
Figure 14:
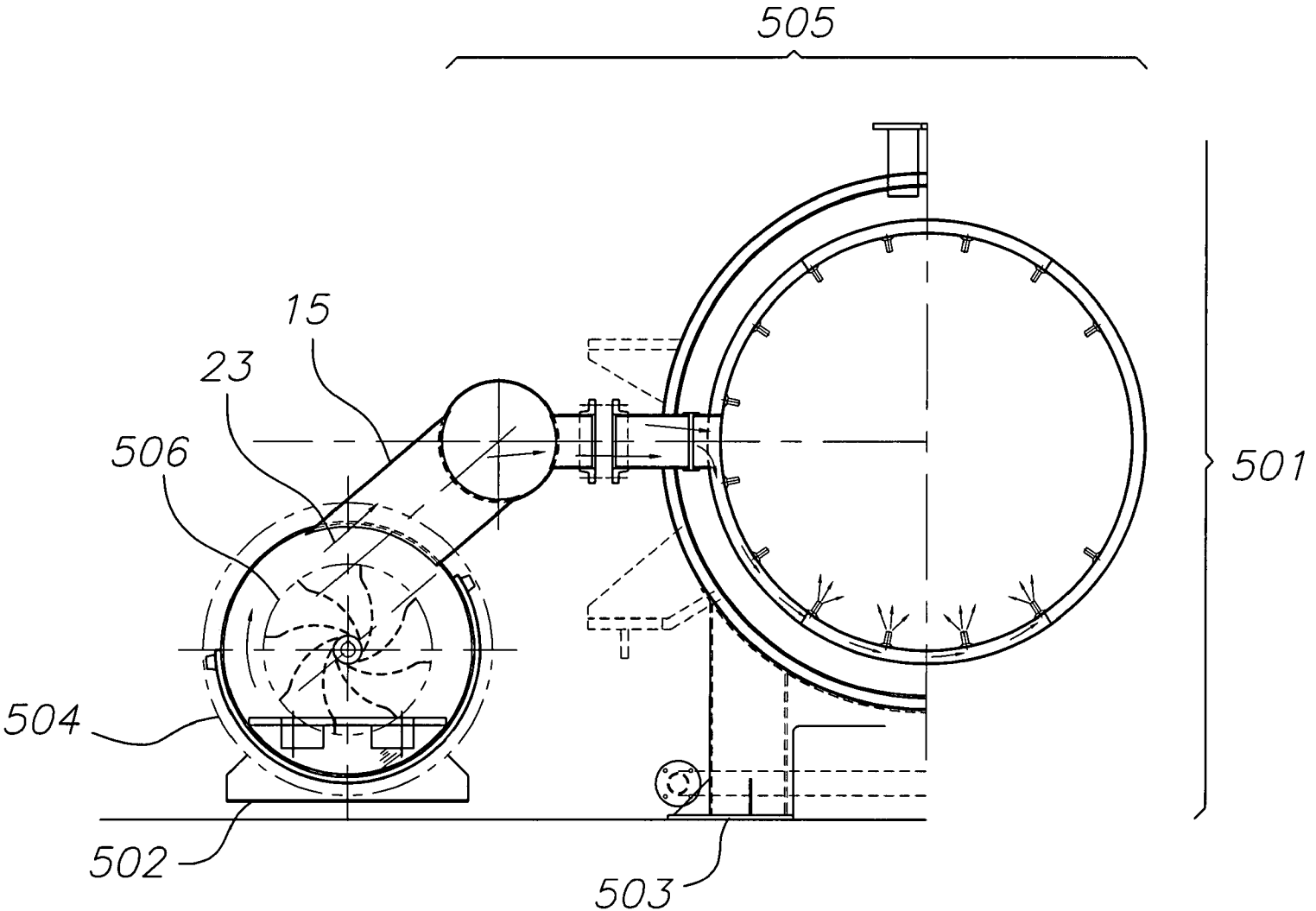
FIG. 14 shows a front view of one embodiment of the vacuum furnace in section so as to show the inner workings.
Figure 15:
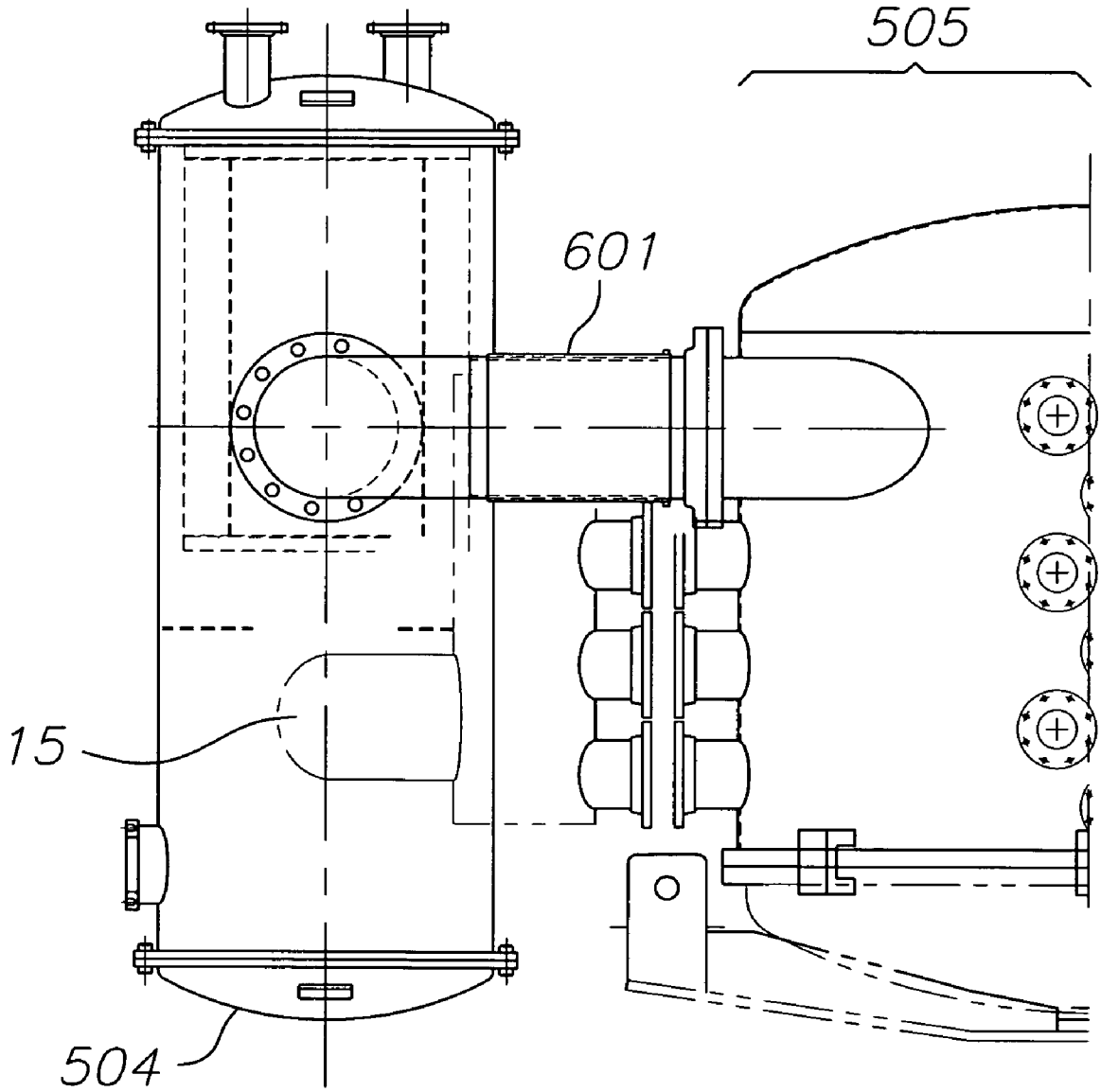
FIG. 15 shows a top view, partly in phantom, of the vacuum furnace seen in FIGS. 13 and 14.
Figure 16:
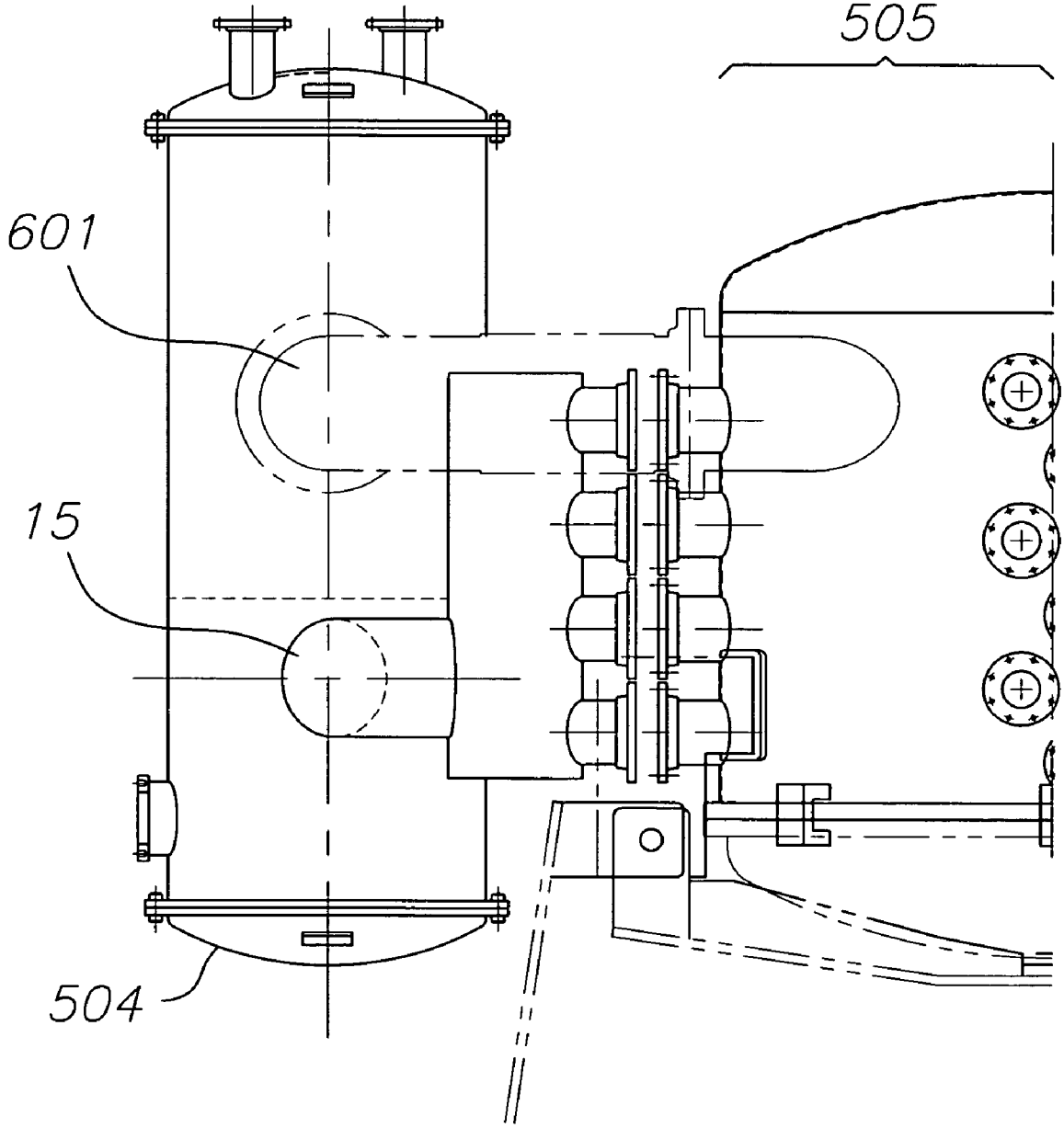
FIG. 16 shows a top view, with different parts in phantom, of the vacuum furnace seen in FIGS. 13 and 14.

FIGS. 13-16 show a preferred embodiment of the complete vacuum furnace from both the top and front views. Referring to FIG. 13, an exit gas manifold 601 is connected to the plenum 505 and the gas supply 504. After gas enters the plenum and cools the load, it leaves the plenum through the exit gas manifold 601. Referring to FIG. 14, the entire furnace 501 is supported by stands 502 and 503. In the gas supply 504 of this embodiment of the invention, a fan 506 turns to pump inert gas through the main piping manifold 15. This gas 23 travels up the manifold 15, which corresponds to the manifold 15 in FIG. 3, and enters the secondary gas manifolds and plenum 505, which correspond to the entirety of FIG. 3. Gas travels into the plenum as discussed above in the description of FIG. 3 and then exits through the exit gas manifold FIG. 15 shows a top view, with some parts in phantom, of FIG. 13. FIG. 16 shows a top view, with different parts in phantom, of FIG. 14.

Thus, through the regulation of valves, the preferred embodiment of this invention provides directional cooling to the load in the plenum of the furnace and thus allows for different portions of the load to be cooled at different rates.

The above described embodiments of the present invention are merely descriptive of its principles and are not to be considered limiting. The scope of the present invention instead shall be determined from the scope of the following claims including their equivalents.

What is claimed is:

1. A vacuum furnace configured to provide directional cooling comprising a cylindrical plenum comprising an inner shell, an outer shell, and a plurality of gas restrictor walls between the inner shell and the outer shell for dividing the cylindrical plenum into a plurality of sectors, each of the plurality of sectors extending along a partial circumference of the cylindrical plenum and each of the plurality of sectors being connected to a separate individual gas inlet for providing cooling gas, wherein each of the separate individual gas inlets enters the cylindrical plenum along a single hemisphere of the cylindrical plenum when the cylindrical plenum is viewed from a side.

2. A vacuum furnace according to claim 1, wherein the cylindrical plenum is configured to provide different levels of cooling from each of the plurality of sectors.

3. A vacuum furnace according to claim 1, further comprising a primary gas manifold, the primary gas manifold dividing into a plurality of secondary gas manifolds, each of the plurality of secondary gas manifolds terminating in a gas inlet for providing cooling gas to a corresponding sector.

4. A vacuum furnace according to claim 1, wherein each separate individual gas inlet has a valve to regulate the cooling gas flow.

5. A vacuum furnace according to claim 4, wherein the valves are pneumatic actuating proportional butterfly throttle valves configured to be equipped for proportional control to provide variable controlled cooling within the cylindrical plenum.

6. A vacuum furnace according to claim 4, wherein the valves may be controlled manually or by an automated process.

7. A vacuum furnace according to claim 1, wherein the plurality of gas restrictor walls divide the cylindrical plenum into four sectors, each sector being connected to one of four gas inlets that each provide cooling gas flows.

8. A vacuum furnace according to claim 1, wherein the cooling gas flow can be controlled so as to cool from the top only.

9. A vacuum furnace according to claim 1, wherein the cooling gas flow can be controlled so as to cool from the bottom only.

10. A vacuum furnace according to claim 1, wherein the cooling gas flow can be controlled so as to cool from both the top and the bottom together.

11. A vacuum furnace according to claim 1, wherein the cooling gas flow can be controlled so as to cool in a manner alternating from the top to the bottom.

12. A vacuum furnace according to claim 1, wherein the cooling gas flow can be controlled so as to cool from the right side only.

13. A vacuum furnace according to claim 1, wherein the cooling gas flow can be controlled so as to cool from the left side only.

14. A vacuum furnace according to claim 1, wherein the cooling gas flow can be controlled so as to cool from both the left and right sides together.

15. A vacuum furnace according to claim 1, wherein the cooling gas flow can be controlled so as to cool in a manner alternating from the left and right sides.

16. A vacuum furnace according to claim 1, wherein the cooling gas flow can be controlled so as to cool from the top, bottom, left, or right or in any combination or permutation thereof; the combination or permutation being able to vary with time, even during mid-cooling of the same load.

17. A vacuum furnace according to claim 1, wherein each separate individual gas inlet comprises a notch-out for gas flow.

18. A vacuum furnace comprising a hot zone gas plenum further comprising a means for providing directional cooling whereby gas flows from a plurality of individual fixed gas inlets into the hot zone gas plenum from only a single hemisphere when the hot zone gas plenum is viewed from a side; and a means for directing the gas flowing into the hot zone gas plenum so as to provide directional cooling from any combination or permutation of the top, bottom, left, or right sides of the hot zone gas plenum or in any sequence thereof.

19. A vacuum furnace configured to provide directional cooling comprising a plenum comprising an inner shell having a plurality of equally spaced nozzles, an outer shell, and a plurality of gas restrictor walls between the inner shell and the outer shell for dividing the plenum into a plurality of sectors, each of the plurality of sectors configured to supply a cooling gas to a designated number of the plurality of equally spaced nozzles to provide directional cooling to a hot zone within the inner shell, wherein the cooling gas is supplied to each of the plurality of sectors by a separate individual gas inlet, each separate gas inlet being located on a single hemisphere of the plenum when the plenum is viewed from a side.

* * * * *